US007150240B2

(12) United States Patent
Gillman et al.

(10) Patent No.: US 7,150,240 B2
(45) Date of Patent: Dec. 19, 2006

(54) METHOD AND APPARATUS FOR MANEUVERING A WATERCRAFT

(75) Inventors: Stephen V. Gillman, Grand Blanc, MI (US); Timothy W. Kaufmann, Frankenmuth, MI (US); Matt H. Jimkoski, Freeland, MI (US); Brian J. Magnus, Frankenmuth, MI (US)

(73) Assignee: Delphi Technologies, Inc., Troy, MI (US)

( * ) Notice: Subject to any disclaimer, the term of this patent is extended or adjusted under 35 U.S.C. 154(b) by 13 days.

(21) Appl. No.: 10/803,571

(22) Filed: Mar. 17, 2004

(65) Prior Publication Data

US 2005/0204985 A1 Sep. 22, 2005

(51) Int. Cl.
*B63H 25/10* (2006.01)
*B63H 25/46* (2006.01)

(52) U.S. Cl. ..... 114/144 R; 114/151

(58) Field of Classification Search ..... 114/144 R, 114/151; 74/480 B, 481, 486, 491, 492, 74/494

See application file for complete search history.

(56) References Cited

U.S. PATENT DOCUMENTS

| | | | | |
|---|---|---|---|---|
| 4,691,659 | A * | 9/1987 | Ito et al. | 114/144 R |
| 6,535,806 | B1 | 3/2003 | Millsap et al. | 701/42 |
| 6,588,540 | B1 | 7/2003 | Graber et al. | 180/402 |
| 6,865,996 | B1 * | 3/2005 | Borrett | 114/144 B |
| 2001/0029134 | A1 * | 10/2001 | Moffet | 440/41 |
| 2003/0079668 | A1 * | 5/2003 | Morvillo | 114/151 |

* cited by examiner

*Primary Examiner*—Ed Swinehart
(74) *Attorney, Agent, or Firm*—Michael D. Smith

(57) ABSTRACT

A watercraft steer-by-wire control system comprising: an input device; at least one transducer in operable communication with the input device; a rudder control system in operable communication with the input device and configured to control a rudder of a watercraft; and a bow thruster control system in operable communication with the at least one transducer and configured to control a bow thruster of the watercraft. A method for the maneuvering if a watercraft. The method comprises: applying a force in a first degree of freedom of an input device; measuring the movement of the input device in the first degree of freedom; converting the movement into a signal proportional to the amount of movement; and transmitting the signal to a bow thruster control system.

11 Claims, 4 Drawing Sheets

METHOD AND APPARATUS FOR MANEUVERING A WATERCRAFT

BACKGROUND

The field of the disclosed method and apparatus relates to the maneuvering of a watercraft, and specifically to a steer-by-wire system for maneuvering the watercraft. More specifically, the field of the disclosed apparatus relates to a steer-by-wire system that integrates steering and bow thrusting.

Traditionally, powered watercraft have had steering difficulty at speeds below a threshold speed. This difficulty is often seen during watercraft docking procedures, which commonly occur below the threshold speed of various watercraft. The difficulty manifests in yaw at the bow of the watercraft. To help minimize the effects of yaw on the control of the watercraft, devices known as bow thrusters have come into use. Basically, these bow thrusters operate on the principle of creating a force to counteract the unwanted lateral swinging of the bow of the boat, to thereby stabilize the lateral position of the bow. One such conventional bow thruster involves the disposition of a motorized propeller beneath the water line adjacent the bow of a boat, whereby rotation of the propeller blade in one direction or another creates a thrust in a direction dictated by rotational blade pitch direction. The thrust is used to move the bow of the watercraft in the opposite direction of unwanted yaw, thereby canceling the same.

Currently, the steering controls and bow thrusting controls are separate controls on a control panel of a watercraft. Attempting to control the steering and the bow thrusting of a watercraft can be very difficult and non-intuitive. Thus, a steer-by-wire system that integrates steering and bow thrusting is desired.

SUMMARY

The currently disclosed apparatus relates to a watercraft steer-by-wire control system comprising: an input device; at least one transducer in operable communication with the input device; a rudder control system in operable communication with the input device and configured to control a rudder of a watercraft; and a bow thruster control system in operable communication with the at least one transducer and configured to control a bow thruster of the watercraft.

The currently disclosed apparatus also relates to a bow thrust input device comprising: an input device with a first degree of freedom and a second degree of freedom; at least one transducer in operable communication with the input device; wherein the at least one transducer is configured to measure change in the second degree of freedom and transmit a signal to a bow thruster control system.

The disclosed apparatus, in addition, relates to a watercraft control system comprising: a bow thrust input device with a first degree of freedom and a second degree of freedom; at least one transducer in operable communication with the bow thrust input device and is configured to measure change in the second degree of freedom; a bow thruster control system in operable communication with the at least one transducer and a bow thruster; and wherein the watercraft control system is configured to convert second degree of freedom movement of the bow thrust input device into a signal that controls the operation of the bow thruster.

The disclosed method relates to maneuvering a watercraft. The method comprises: applying a force in a first degree of freedom of an input device; measuring the movement of the input device in the first degree of freedom; converting the movement into a signal proportional to the amount of movement; and transmitting the signal to a bow thruster control system.

BRIEF DESCRIPTION OF DRAWINGS

Referring to the exemplary drawings wherein like elements are numbered alike in the several Figures.

DETAILED DESCRIPTION

Figure 1:
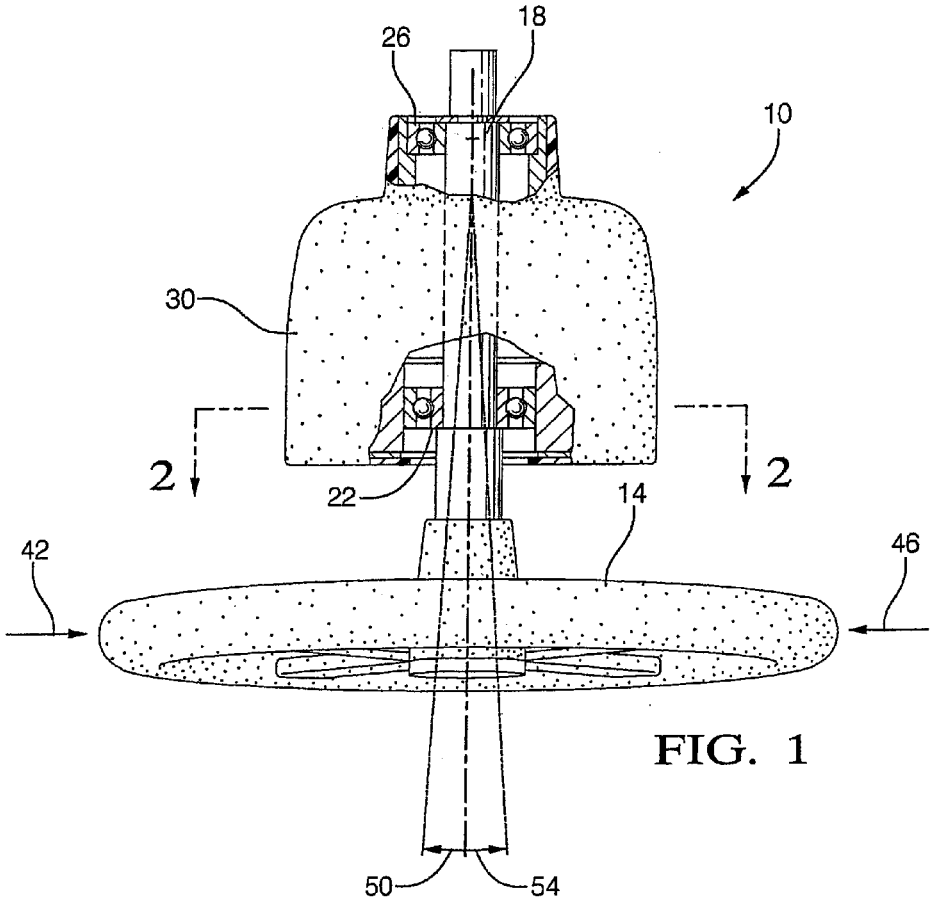
FIG. 1 is a top cross-sectional view of one embodiment of the disclosed apparatus.

Referring to FIG. 1, one embodiment of the disclosed integrated steering and bow thruster control apparatus 10 is shown. A steering and bow thruster control input device 14 is shown in operable communication with a shaft 18. The steering and bow thruster control input device 14 in this embodiment may be a hand wheel, but may be any other steering input device such as, but not limited to: a two handle steering wheel, or an automobile type steering wheel. In one embodiment, the shaft 18 is mounted on a first bearing 22 and a second bearing 26. The second bearing 26 may be a spherical bearing, or any other device which can support the shaft 18 and allow for some angular misalignment of the shaft 18. The first bearing 22 is housed in an actuator housing 30.

Figure 2:
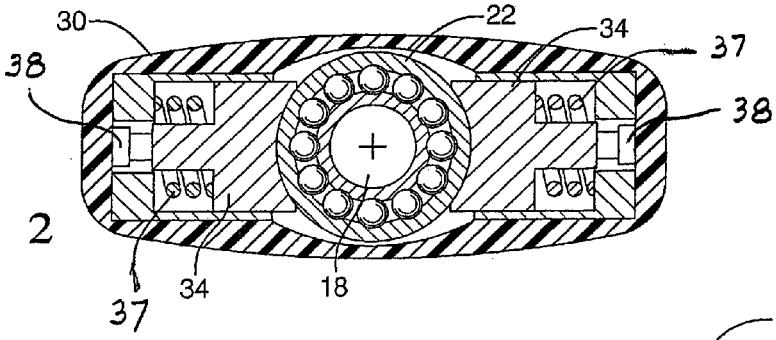
FIG. 2 is a cross-sectional view through the plane A—A from FIG. 1.
Figure 3:
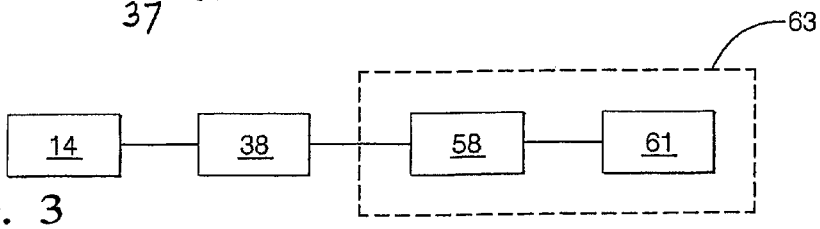
FIG. 3 is a schematic of one embodiment of the disclosed apparatus.
Figure 4:
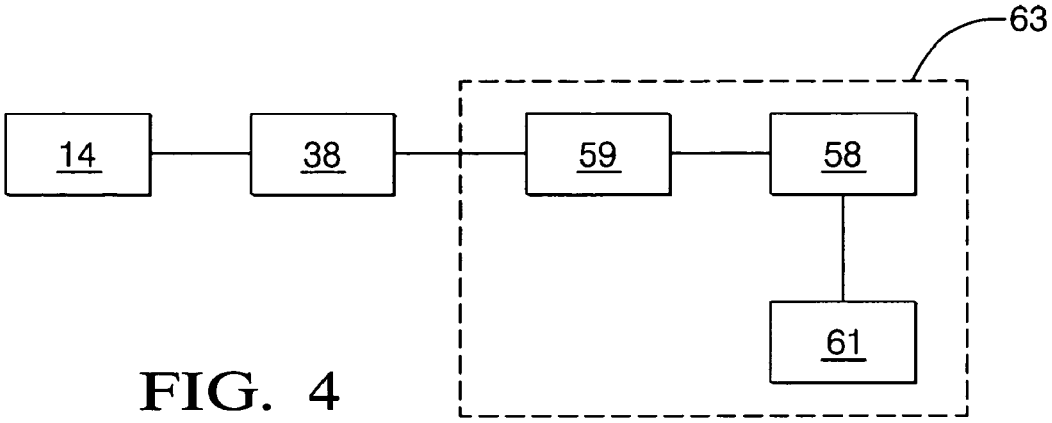
FIG. 4 is a schematic of another embodiment of the disclosed apparatus.

FIG. 2 is a sectional view through the first bearing 22. Two thrust shoes 34 are shown in operable communication with the bearing 22. The thrust shoes 34 held against the bearing 22 due to a preload exerted on the thrust shoes 34 by force elements 37. The force elements 37 may be any properly sized device which will provide a sufficient preload to the thrust shoes 34, such a device may be, but is not limited to: a leaf spring or a coil spring. The thrust shoes 34 are also in operable communication with one or more transducers 38. The transducers 38 may be position sensors, force sensors, or may be bow thruster switches. If position sensors are used, the sensors may detect how much the shoes 34 move relative to the actuator housing 30. Thus, when an operator exerts a force, above a certain design minimum, on the hand wheel 14 in the direction of the arrow 42 or arrow 46 which are substantially normal to the shaft 18, the shaft 18 will move a certain angular amount in the direction of the arrow 50 or arrow 54. Thus the shoe position sensors 38 will detect the amount the shaft 18 moves the shoes 34, and the sensors 38 may transmit a signal proportional to the amount of shaft 18 movement that will activate a bow thruster in a particular direction. If bow thruster switches are used for the transducers 38, then if the shaft 18 moves to left a certain minimum design distance, a left side bow thruster switch 38 will be engaged, thereby sending a signal to a bow thruster control system or a bow thruster actuator and initiating a bow thrusting action in one direction. If a right side bow thruster switch 38 is engaged by the shaft 18 moving to the right, then another bow thrusting action will be initiated, which may or may not be in a different direction for when the left side bow thruster switch is engaged. FIG. 3 shows a simplified schematic diagram of the bow thruster control system 63. The steering and bow thruster control input device 14 is in operable communication with the one or more transducers 38. The one or more transducers 38 are in operable communication with a bow thruster actuator 58. The bow thruster actuator is in operable communication with a bow thruster 61. The bow thruster actuator and bow thruster comprise the bow thruster control system 63. The bow thruster actuator 58 will initiate a bow thrust in a direction and amount according to signals transmitted by the transducer 38 that are proportional to readings measured by the transducer 38, as explained below in FIGS. 6, 7 and 8. Hence, the operator of the watercraft may steer the watercraft via turning the hand wheel 14, while simultaneously operating the bow thruster by applying a minimum force to the hand wheel 14 in the directions of the arrows 42,46. FIG. 4 shows a simplified schematic diagram of another embodiment of the bow thruster control system. In this embodiment, there is a controller 59 in operable communication with the transducers 38 and thruster actuator 58. The bow thruster control system in this embodiment comprises the controller, bow thruster actuator 58 and bow thruster 61. Signals from the transducers 38 are transmitted to the controller 59. The controller may also be in operable communication with other systems on the watercraft, and may analyze various signals being transmitted to it from the transducers 38 and other systems. The controller 59 processes the signals transmitted to it, develops a control signal therefrom, and transmits the control signal to the thruster actuator 58. In order to perform the prescribed functions and desired processing, as well as the computations therefore (e.g., the control algorithm(s), and the like), the controller 59 may include, but not be limited to, a processor(s), computer(s), memory, storage, register(s), timing, interrupt(s), communication interface(s), and input/output signal interfaces, and the like, as well as combinations comprising at least one of the foregoing. For example, the controller 59 may include signal input signal filtering to enable accurate sampling and conversion or acquisitions of such signals from communications interfaces.

The operator may choose to steer the watercraft only by rotating the hand wheel 14, and not apply a minimum force in the direction of the arrows 42, 46, or the operator may choose to only operate the bow thruster by applying a minimum force in the direction of the arrows 42, 46. Alternatively, the apparatus may be configured such that instead of a left and right force being applied to the hand wheel, forces in other directions may be used, for example the apparatus may be configured such that an up and down force on the hand wheel may be applied, that is, a force in the 12 o'clock direction of the hand wheel and a force in the 6 o'clock direction of the hand wheel and substantially normal to the shaft 18, or forces in the 10:30 and 4:30 direction of the hand wheel and substantially normal to the shaft 18 may be used, or any other combination. Additionally, in another embodiment, for example, the apparatus may be configured such that two discrete and quickly consecutive forces applied to the hand wheel in a particular direction will activate the bow thruster in a first direction, and three 3 discrete forces applied to the hand wheel in the same direction, will operate activate the bow thruster in an opposite direction. Of course a variety of configurations may be used to operate the bow thruster through the input device.

Only a portion of the shaft 18 is shown in FIG. 1. A portion of the shaft 18 not shown is in operable communication with a rudder control system. The specifics of the steer-by-wire rudder control system has previously been disclosed in a patent application entitled "WATERCRAFT STEER-BY-WIRE SYSTEM", Ser. No. 10/643,512, filing date Aug. 19, 2003, the contents of which are incorporated by reference herein in their entirety.

Figure 5:
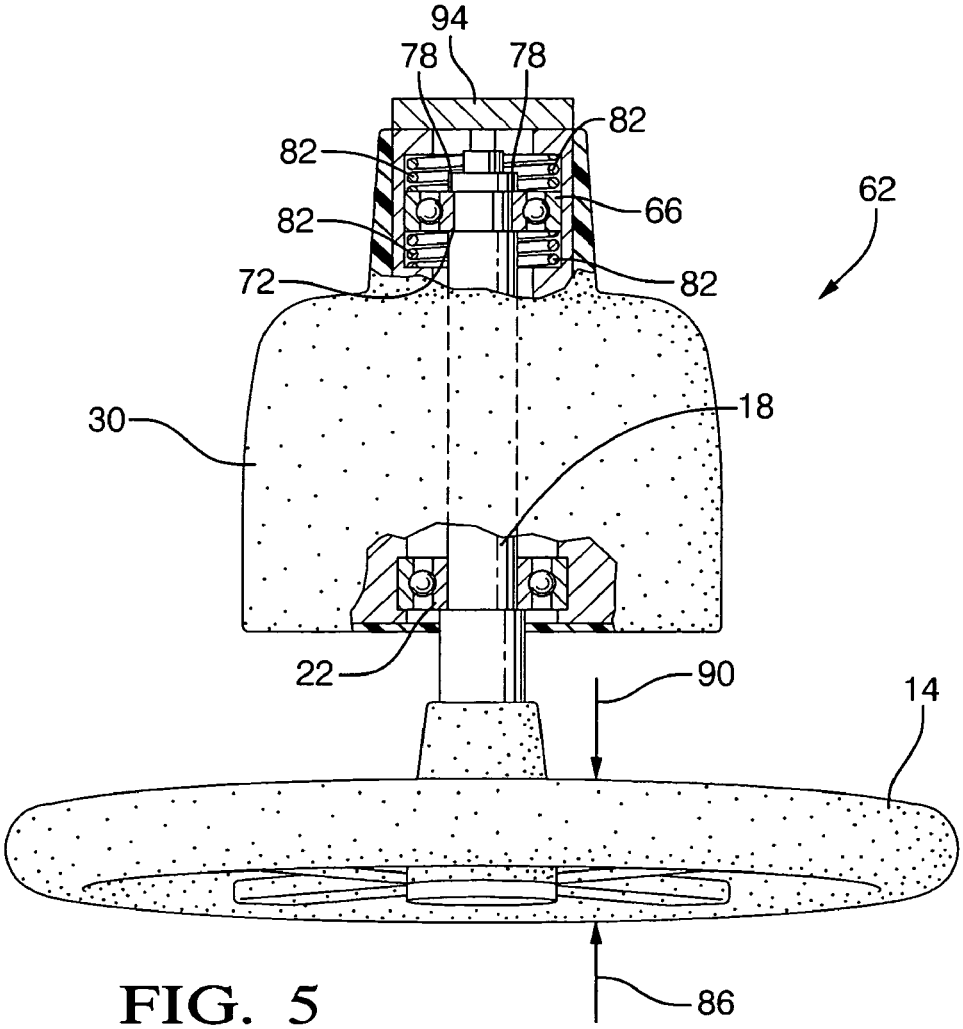
FIG. 5 is a top cross-sectional view of another embodiment of the disclosed apparatus.

FIG. 5 shows another embodiment of the disclosed bow thruster control apparatus 62. In this embodiment there may be a first bearing 22, however an embodiment without bearing 22 may utilized. A second bearing 66 is located between two flanges 72, 78 on the shaft 18. The second bearing 66 is equally preloaded by springs 82 in both axial (relative to the shaft 18) directions. Hence, in this embodiment, the operator can activate the bow thruster by exerting a minimum amount of force on the hand wheel 14 in one of the direction of the arrows 86, 90, which is co-axial to the shaft 18. When a minimum design force is exerted on the hand wheel 14, the shaft 18 will move relative to a transducer 94. The transducer 94 may be a "3-position" switch. In one embodiment, when the shaft is in a "neutral" position, that is when no operator force is exerted on the hand wheel 14, the 3-position switch 94 may be configured to also be in a "neutral" position or "off" position, and with the bow thruster in an inactivated state. If the minimum design force is applied in a downward direction 86 on the hand wheel 14, then the 3-position switch 94 may be switched into a first position which initiates a bow thrusting action in one direction. If a minimum of force is applied in upward direction 90 on the hand wheel 14, the 3-position switch 94 may be switched into a second position which initiates a bow thrusting action in a different direction. Of course, the 3-position switch 94 may be configured in a variety of ways, e.g. when the 3-position is in a neutral position, it initiates a bow thrusting action in a particular direction.

The hand wheel 14 in FIGS. 1 and 4 each have two degrees of freedom. The hand wheel 14 in FIG. 1 has a rotational degree of freedom that controls the rudder of the watercraft, and a degree of freedom in a direction that substantially normal to the shaft 18, in the directions 42 and 46. In the disclosed apparatus, this degree of freedom is used to control the bow thrusting of the watercraft. In FIG. 5, the hand wheel 14 again has a rotational degree of freedom that controls the rudder of the watercraft, and a degree of freedom in a direction that is substantially co-axial to the shaft 18. This may be called a reciprocating degree of freedom, since a force may be applied to push the hand wheel down, and another force may be applied to pull the hand wheel up.

Figure 6:
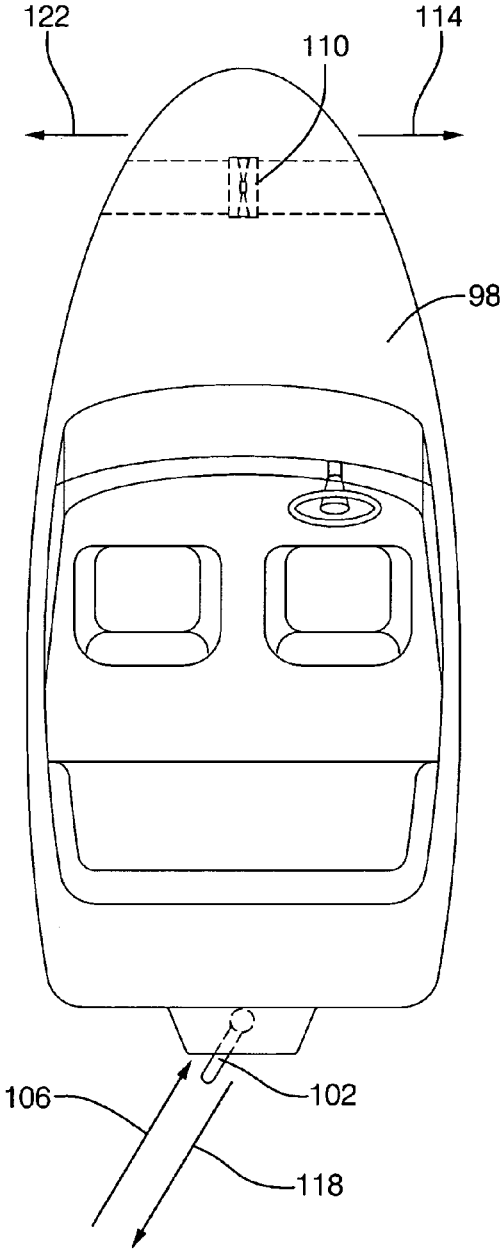
FIG. 6 is a schematic illustrating a watercraft in a translation mode.

Referring now to FIG. 6, the relationship between the bow thruster direction and steering direction is shown when the watercraft 98 is in a "translation" mode. A translation mode is useful, for example, when docking the watercraft, which requires low speed steering. Thus, when in a translation mode, and the watercraft 98 is being docked on the starboard side (right side) the hand wheel 14 (from FIGS. 1 and 4) will be turned in the left direction at some point to maneuver the stern of the watercraft 98 towards the dock on the starboard side. This will orient the rudder 102 such that it is pushing the stern of the watercraft in the direction represented by the arrow 106. Thus, to assist the docking maneuver, the bow thruster 110 will be oriented, when in a translation mode, to push the boat in the direction of the arrow 114, which will assist the docking maneuver towards the starboard side.

Conversely, if the watercraft is put into a reverse gear, then the rudder will exert a force on the watercraft such that it is pushing the stern of the watercraft in the direction represented by the arrow 118, and the bow thruster 110 will orient in the opposite direction and push the boat in the direction of the arrow 122. Such a maneuver would be helpful in docking the watercraft 98 on the port side, for instance.

Figure 7:
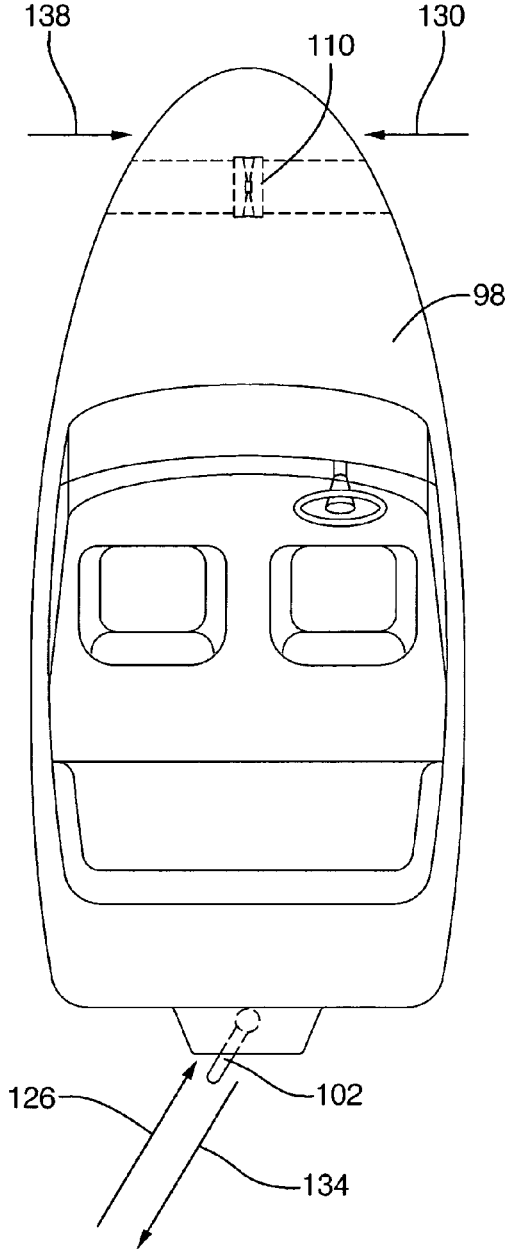
FIG. 7 is a schematic illustrating a watercraft in a yaw mode.

Referring to FIG. 7, the watercraft 98 is shown in a "yaw" mode. Thus, when the hand wheel 14 (from FIGS. 1 and 4) is turned to the port side, the rudder 102 exerts a force on the watercraft in the direction shown by the arrow 126. Since the watercraft is in a yaw mode, then the bow thruster can assist in turning the boat in the port direction by exerting a force on the watercraft in the direction of the arrow 130, thereby when in conjunction with the rudder force, assists in better and faster maneuvering of the watercraft into the port direction. Conversely, if the watercraft is in a reverse gear, then the rudder 102 exerts a force on the watercraft in a reverse direction, shown by the arrow 134, concurrently the bow thruster 110 may also reverse direction and exert a force on the watercraft in the direction of the arrow 138, thereby assisting in turning the stern of the boat into the port direction. NOTE: This is only true for an inboard/outboard or outboard (controlled direction of the propeller/thrust) versus an inboard.

Thus, in one embodiment, if a minimum force is exerted in a starboard direction 42 on the hand wheel 14, the bow thruster control may be configured to adopt a translation mode, and if a minimum force is exerted in a port direction 46 on the hand wheel 14, the bow thruster control may adopt a yaw mode. In another embodiment, the bow thruster control may be configured such that a force in a starboard direction 42 may trigger a yaw mode, and a force in a port direction 46 may trigger a translation mode. In another embodiment, if a minimum force is exerted in an upward direction 90 on the hand wheel 14, the bow thruster control may be configured to adopt a translation mode, and if a minimum force is exerted in a downward direction 86 on the hand wheel 14, the bow thruster control may adopt a yaw mode. Of course, in another embodiment, the bow thruster control may be configured such that a force in an upward direction 90 may trigger a yaw mode, and a force in a downward direction 86 may trigger a translation mode. It should be understood that in other embodiments, different configurations for associating yaw and translation modes with forces or the lack of forces applied to the hand wheel may be used to allow an operator to control both steering and bow thrust through one input device 14.

Figure 8:
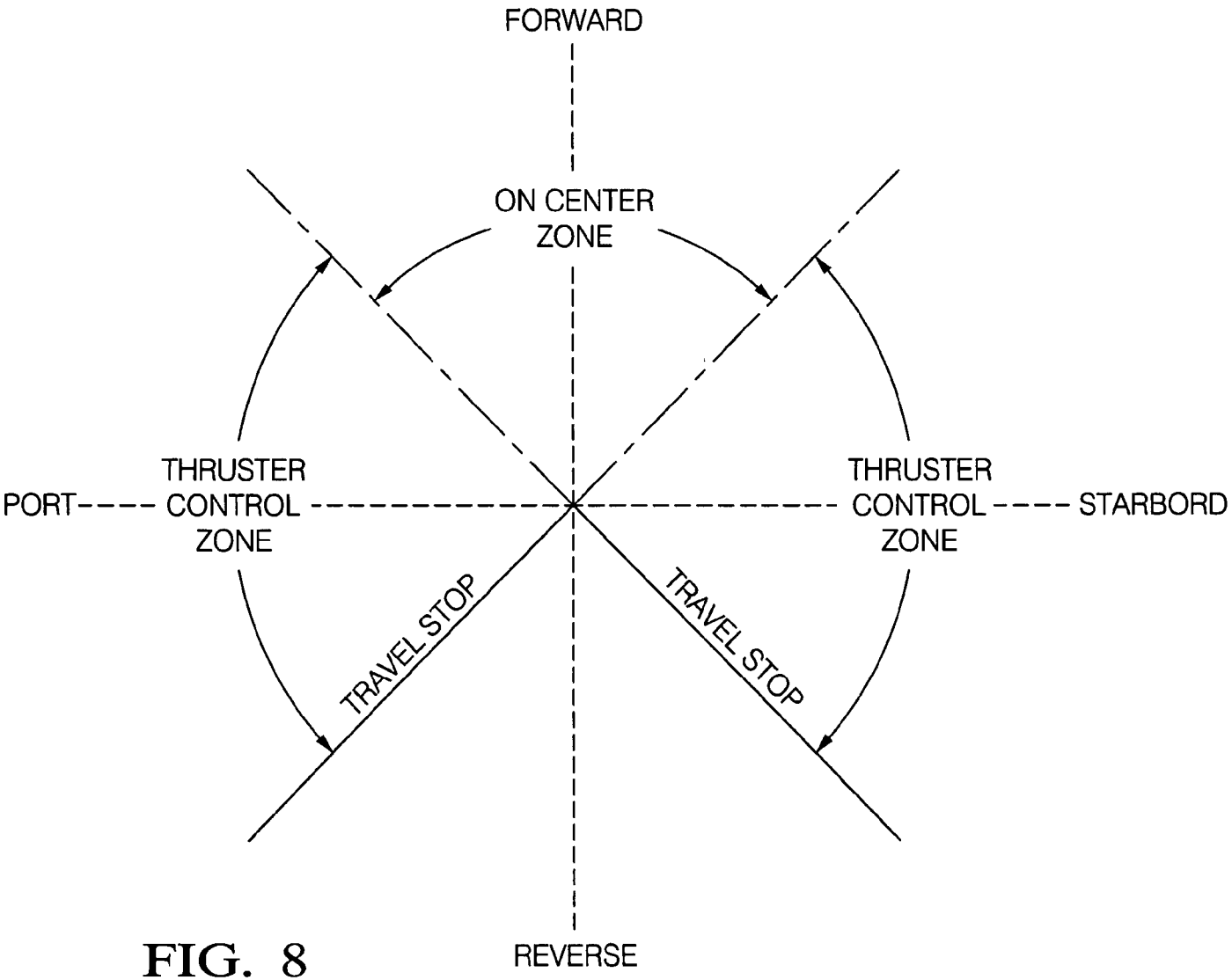
FIG. 8 illustrates how bow thrusting is dependent on the thrust control and on center zones of the input device.

FIG. 8 shows one embodiment of how the bow thruster control system may be configured. An axis is shown representative of the direction the hand wheel 14 may be turned, the hand wheel may be oriented in a forward direction, may be turned in a port direction up to the travel stop, and may be turned in a starboard direction up to another travel stop. If the hand wheel is in a "on center zone" region, the bow thruster will not initiate. However, once the hand wheel is turned into either of the two "thruster control zones" (one on the port side, and the other on the starboard side), then the bow thruster will initiate and provide extra maneuverability to the watercraft. The angular dimensions of the on center zone region, and two thruster control zones regions may be fixed, may vary with watercraft speed, or may vary based on other factors. The travel stops may be fixed, may vary with boat speed, or may vary based on other factors.

The bow thruster direction shown in FIGS. 5 and 6 indicate a direction normal to the stern-to-bow centerline of the watercraft. However, the bow thruster direction need not be in a normal direction, but may be at some other angular orientation, or may be varied during the operation of the watercraft. Additionally, the bow thruster when initiated, may operate at a single speed, multiple speeds, or may be infinitely varied between a maximum and minimum speed. The speed and/or direction of the bow thruster may be configured to vary based on various watercraft operating factors, including but not limited to watercraft speed and sharpness of turning.

The disclosed apparatus for maneuvering a watercraft allows an operator to control steering and bow thrusting via one integrated input device. This may simplify the operation of the watercraft, may allow for a more intuitive maneuvering of the watercraft, and will simplify the control panel of the watercraft since there will no longer be a need for a separate input device such as a lever, knob or buttons for operating the bow thruster.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims. Moreover, the use of the terms first, second, etc. do not denote any order or importance, but rather the terms first, second, etc. are used to distinguish one element from another.

What is claimed is:

1. A watercraft steer-by-wire control system, comprising:

a steering input device configured for rotational movement about a moveable axis of the steering input device, the moveable axis extending longitudinally through the steering input device, the steering input device also configured for movement in a range defined by a first position and a second position;

a rudder control system in operable communication with the steering input device, wherein rotational movement of the steering input device about the moveable axis induces the rudder control system to move a rudder; and at least one transducer configured to detect translational movement of the steering input device in the range, wherein the transducer sends a signal to a bow thruster control system in order to control a bow thruster based on the movement of the steering input device in the range.

2. The watercraft steer-by-wire control system of claim 1, wherein the steering input device is a shaft.

3. The watercraft steer-by-wire control system of claim 1, wherein the steering input device is spring biased into a central position and the movement of the range is substantially perpendicular to the central position.

4. The watercraft steer-by-wire control system of claim 1, wherein the movement of the steering input device in the range induces the bow thruster to operate one of two modes, a yaw mode and a translation mode.

5. The watercraft steer-by-wire control system of claim 1, wherein the bow thruster is configured to operate at a constant speed.

6. The watercraft steer-by-wire control system of claim 1, wherein the steering input device is rotatably received within a first bearing and a second bearing, the first bearing being received within an actuator housing and the second bearing being configured to allow angular misalignment of the steering input device.

7. The watercraft steer-by-wire control system of claim 6, further comprising a pair of thrust shoes movably received within the actuator housing and configured to be in operable communication with a periphery of the first bearing, the pair of thrust shoes being biased against the periphery of the bearing by a pair of springs, wherein the at least one transducer comprises a pair of transducers, each of one of the pair of transducers being configured to detect translational movement of the steering input device in the range, wherein the pair of transducers each send a signal to the bow thruster control system in order to control the bow thruster when the steering input device moves in the range, wherein one of the pair of transducers is configured to detect translational movement of one of the pair of thrust shoes and the other one of the pair of transducers being configured to detect translational movement of the other one of the pair of thrust shoes.

8. The watercraft steer-by-wire control system of claim 1, wherein the steering input device is rotatably received within a first bearing and a second bearing, the first bearing being movably received within an actuator housing for movement in the range, wherein the range is substantially parallel to an axis of rotation of the steering input device.

9. The watercraft steer-by-wire control system of claim 8, wherein the at least one transducer is a 3-position switch.

10. A steer-by-wire control system for a watercraft, the watercraft having a rudder and a bow thruster, comprising:

a steering input device having a shaft configured for rotational movement about a longitudinal axis of the shaft, the shaft having a first position where the longitudinal axis is disposed on a first axis, the shaft having a second position where at least a portion of the longitudinal axis is disposed a first distance from the first axis;

a rudder control system operably communicating with the steering input device, the rudder control system configured to move the rudder in response to rotational movement of the shaft about the longitudinal axis;

a transducer configured to detect a translational movement of the shaft from the first position to the second position; and a bow thruster control system operably communicating with the transducer, the bow thruster control system controlling operation of the bow thruster based on the movement of the shaft from the first position to the second position.

11. A method for maneuvering a watercraft utilizing a steer-by-wire control system, the watercraft having a rudder and a bow thruster, the steer-by wire control system having a steering input device with a shaft configured for rotational movement about a longitudinal axis of the shaft, the shaft having a first position where the longitudinal axis is disposed on a first axis, the shaft having a second position where at least a portion of the longitudinal axis is disposed a first distance from the first axis, the method comprising:

moving the shaft from the first position to the second position;

controlling a bow thruster based on movement of the shaft between the first and the second positions;

rotating the shaft a first rotational distance about the longitudinal axis of the shaft; and controlling an operational position of the rudder based on the first rotational distance.

* * * * *